United States Patent [19]

Schippers

[11] 3,955,347

[45] May 11, 1976

[54] ANTI-NOISE STRUCTURES ON MULTI-POSITION TEXTILE MACHINES

[75] Inventor: Heinz Schippers, Remscheid, Germany

[73] Assignee: Barmag Barmer Maschinenfabrik Aktiengesellschaft, Wuppertal, Germany

[22] Filed: Sept. 12, 1974

[21] Appl. No.: 505,330

[30] Foreign Application Priority Data

Sept. 18, 1973 Germany ..... 2346869

[52] U.S. Cl. ..... 57/1 R; 181/33 GB; 181/33 K; 160/84 R; 160/188; 160/331

[51] Int. Cl.[2] ..... D01H 9/00

[58] Field of Search ..... 181/33 R, 33 GB, 33 K; 57/1 R, 108; 160/11, 84 R, 84 H, 84 V, 185, 188, 196; 150, 331, 265

[56] References Cited

UNITED STATES PATENTS

| | | | |
|---|---|---|---|
| 778,228 | 12/1904 | Dodge et al. | 160/265 X |
| 1,480,918 | 1/1924 | Szirmay | 160/331 |
| 2,354,832 | 8/1944 | Ristine | 160/11 |
| 2,986,210 | 5/1961 | Rosenfeld | 160/84 H |
| 3,146,572 | 9/1964 | Keyser | 57/1 R |
| 3,606,751 | 9/1971 | Weller et al. | 57/108 X |
| 3,700,068 | 10/1972 | Francis | 181/33 K |
| 3,732,914 | 5/1973 | Flageollet | 160/331 |
| 3,782,087 | 1/1974 | Franzen et al. | 181/33 R X |

*Primary Examiner*—John F. Gonzales
*Attorney, Agent, or Firm*—Johnston, Keil, Thompson & Shurtleff

[57] ABSTRACT

Anti-noise structures on multi-position textile machines, consisting of sound-damping lining walls wholly or partially covering the longitudinal front of the machine, which walls are movable in such a way that the working positions of the textile machine can be individually laid open for operation or tending.

9 Claims, 14 Drawing Figures

ANTI-NOISE STRUCTURES ON MULTI-POSITION TEXTILE MACHINES

Questions of the elimination and reduction of the noise effects emanating from industrial plant operations have for years been the object of intensive efforts in design. The measures thus far proposed for reducing the noise burden had especially as their purpose the avoidance or minimizing of noises of high sound volume, thus, for example, by resilient suspension of the rotating machine parts, noise-damping construction of the machine bed, use of low-noise gears, etc. Counteracting these measures are the efforts toward ever increasing speeds of operation, so that their success in the combatting of noise must remain limited.

For defense against the noise nuisance it has already been proposed in the case of textile machines, to line the noise-emissive parts of the machines with sound-damping structures. Such sound-damping linings have sound-reflecting and/or sound-absorbing properties.

The lining of machine parts in textile machines must not impair the good accessibility of these machine parts to the operators. On the other hand, in the case of multi-position textile machines, such as, for example, winding units for chemical fiber spinning installations, chemical fiber stretching installations, false-twist crimping machines, double-twist twist machines, there exists the problem that the machine is tended not only at standstill, i.e., simultaneously for all the processing places, but also in operation, place by place, with the machine otherwise running. Since, however, it is precisely the operating personnel that must be protected against the noise nuisance, such textile machine linings, which do not permit the exposing of individual working positions to be tended, but otherwise keeping all the operating positions in operation screened, solve their function of anti-noise protection only very imperfectly. This disadvantage is avoided if the sound-damping lining is constructed as individual doors in front of each treatment place (cf, for example, Swiss Pat. No. 492,040 and German published application No. 2,130,621). These executions, however, the drawback of deficient accessibility for tending when several treatment places, or the entire textile machine, is to be tended simultaneously. Here, the opening doors form an appreciable obstacle which, however, makes itself troublesomely noticeable even if an automatic bobbin change is to take place through a doffer drivable as an independent unit along the machine front. The solution according to German published application No. 2,130,621, has, moreover, proved to be very expensive. Also, it is usable only for certain machines in a certain type of construction. Their disadvantage is, in particular, that of the economic expensiveness and of restricted applicability. With such a shielding arrangement, too, it is merely possible to line individual machine parts, but not relatively large machine surfaces.

Roller shutters movable up and down, which simultaneously cover single or several operating places, have not as yet become known, but they would also be disadvantageous since they require for each shielding zone a storage arrangement of their own and thereby demand valuable or unavailable space on the machine front.

According to German published application No. 1,293,065 there is sought a compromise, however, between a noise shielding effective during the tending and good accessibility for tending. The lining is constructed as a supporting apron for the guidance or support of all the machine parts subject to tending. The disadvantage of this structure lies in the non-shielding of the processing machine parts, such as spindles and delivery rollers—which above all through their high turning speeds contribute especially to the noise nuisance.

The invention seeks to avoid the disadvantages enumerated. The problem consists especially in creating a lining on textile machines which on tending of an individual treatment place maintains the shielding of remaining treatment places, which, on the other hand, also permits the laying open of the machine in its entirety, as, for example, in the case of changeovers for other products, or as is necessary in maintenance. Further, parts of the lining, such as, for example, doors, do not extend into the tending passage and hence do not impede the traffic of the usual bobbin carriages or also the tending of the textile machine by a doffer.

For the solution of the problem posed, the invention proposes an anti-noise arrangement of the type described at the outset, in which the lining walls for each prescribed shielded zone consist of two upstanding foils movable in horizontal direction, in which system each foil has the length of the shielded zone and one end thereof is associated with a foil storer.

Let it be mentioned that the term "foil" in this invention is used for any sound-reflecting or sound-absorbing surface structure, such as, for example, plastic foils, tissue, coated tissue, or rollade-like structures consisting of individual strips. Foil storers in the sense of this invention are, above all, take-up rollers and folding arrangements. As folding arrangements there are used, for example, "Nuremberg shears", which are movable horizontally, and on which the foil is suspended. Likewise, the folding arrangement can be formed by the means that the guide track in which the foil is movably guided has at its one end into a folded or zig-zag course.

By shielding zone there is meant a part defined by its horizontal and vertical extent of the machine front, which is to be protected by lining of the walls against sound emission. The shielding zone will extend preferably over the entire machine front, insofar as the sound-damping foils used can be guided and moved sufficiently accurately lengthwise over the entire length of the machine front. Depending on the constructive conditions, the longitudinal front of the machine can also be subdivided into two or more shielding zones lying successively in horizontal direction.

In the vertical extent, the shielding zone will be chosen in such a way that the machine parts emitting loud noise are noise-shielded. Here, too, there can be provided two or more shielding zones lying one above the other. Likewise it is conceivable that the shielding zone does not cover the entire front height of the machine—which can be expedient especially for reasons of thermal engineering. It was ascertained by measurements that sound-absorbing members extending only over a limited height brings about successful results not to be overlooked in anti-noise technique in favor of the operating person (Melliand Textilberichte 1959, page 565).

The advantage of the anti-noise arrangement according to this invention lies in the versatile utility for any desired type of multi-position textile machines and especially in its great variety of functions. When none of the processing places allocated to a shielded zone is to be tended, then the foil storers are filled only to such an extent that both foils form a closed seam. This seam is presented as an abutting edge when the two foils are movable in one and the same plane. If the two foils are movable with respect to one another in parallel planes, then the seam preferably presents itself as a slight overlapping. At least the seam must in this case form a sound labyrinth whose exit lies perpendicular to the machine front. Let it be mentioned that the overlapping of the foils—if the foils are movable in planes parallel to one another—can also be so great that each foil covers the entire shielded zone and thereby there sets in a reinforced anti-noise protection as long as no tending is required.

If a single operating place is to be tended, say, because a thread break has occurred there, then both foils are moved by hand or by motor with a synchronous speed in such a way that the seam comes to lie at the working place to be tended. In this movement the seam should preferably be closed for anti-noise reasons. It is also possible, however, to open the seam first to a prescribed gap width of one or more operating places, and to move the foils then with the seam open. It should be remarked that the movement of the foils brings about a filling of the foil storer allocated to the advancing foil and an emptying of the foil storer allocated to the lagging foil. If larger parts of the machine front are to be laid open, then the opening width of the seam can be adjusted at will. In the extreme case the entire shielding front can be laid open, so that the covering walls no longer present any impediment for the tending of the machine.

In an advantageous further development of the invention, the two foils allocated in each case to a shielding zone are driven by motor in both directions at will with synchronous speed or independently of one another. The drive with synchronous speed has the advantage that the two foils allocated in each case to a shielding zone can be driven by motor with closed seam or with a prescribed seam opening width.

The movement of the foils—as is further provided in advantageous further development of the invention—can also take place through a doffer. By doffer there is meant a bobbin changing automatic unit constructed as an independently movable unit, which is drivable along the machine front and is positionable in front of each tending place (cf., for example, German Pat. application No. OS 21 23 689 and German Pat. application No. OS 21 28 974). There, the doffer can simultaneously take over the drive of the foils or merely trigger the motor drives allocated to the foils by suitable switching arrangements, or else, through mechanical coupling with both foil ends, synchronize the movement of the two foils.

In the movement and the storage of the foils it is to be heeded that essentially only pull forces can be exerted on the foils. A further difficulty lies in the fact that with use of take-up rollers as foil storers the foils are not wound up and moved at a constant rate. For this reason there is proposed as a preferred execution an anti-noise arrangement with at least one motor driven cable extending over the shielding zone, in which the cable is connected with a foil in its draw-out direction. Through the motor-driven cable there can be assured for the foil web connected with it a substantially constant speed in both directions. The synchronization of the other foil is accomplished, say, by mechanical connection of the two foil ends at the seam place or else, for example, by a separate cable pull with motor drive for each foil.

Since there is provided a constant speed of movement for both foil webs, take-up rollers provided as foil storers should be drivable by means of slip drive, for example, over a slip coupling. For the monitoring of the textile machine the foils can be made of transparent material. In order to increase the sound-absorption action of the foil there is proposed a foil whose specific weight amounts to more than 4 kg/dm$^3$.

Alternatively to this, in a further advantageous execution, at least one of the foil webs allocated to a shielding zone is provided with a viewing window in the region of the movable end of this foil web. This viewing window arranged in the vicinity of the seam existing between the two foil webs allows the monitoring of the individual working places even with the seam closed, when the seam is moved over the entire shielding zone.

It is necessary to reckon with the fact that in the textile machine encapsulated by covering walls a certain amount of flying fiber is to be observed. Further, it is necessary reckon with the point that the foil undergoes a certain electrostatic charging. To avoid intolerable foulings of the foil webs, each foil web is allocated a cleaning device in the region of the foil storer allocated to it. Such cleaning devices preferably embody stripping devices, such as, for example, brushes, felts or the like, in which, optionally, there is also applied an antistatic fluid.

For the leading off of the heat from the textile machine encapsulated by the anti-noise arrangement there can be used, if need be, a suction system. Through the head take-off in a defined flow there arise advantages for the air conditioning of the machine room.

In the following the invention is explained with the aid of preferred embodiments illustrated in the drawings, wherein:

FIGS. 1*a* and 1*b* show a two-sided textile machine in top plan and side elevation with foil webs and take-up rollers extending over the entire longitudinal fronts of the machine, which are arranged on the longest, side faces of the textile machine;

Figure 10A:
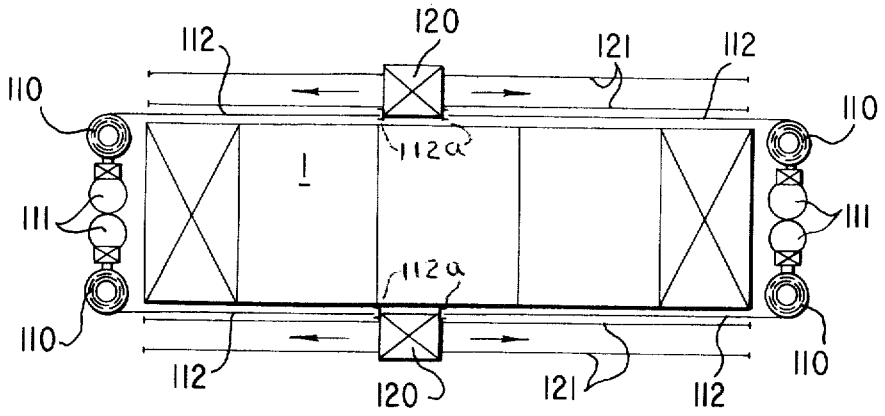
Figure 10B:
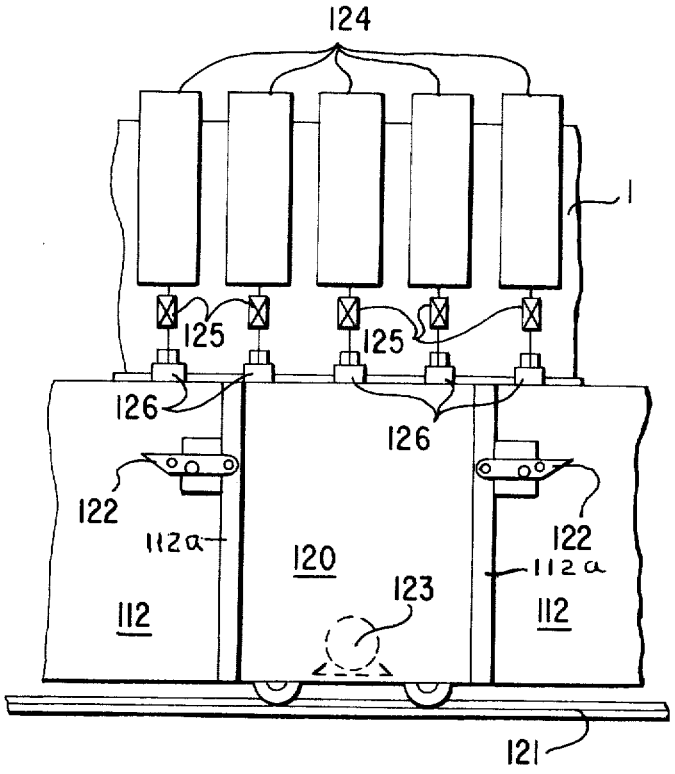
Figure 11A:
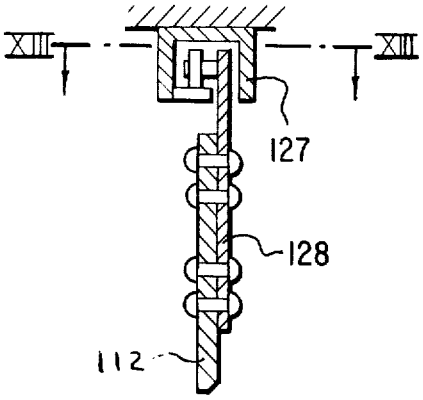
Figure 11B:
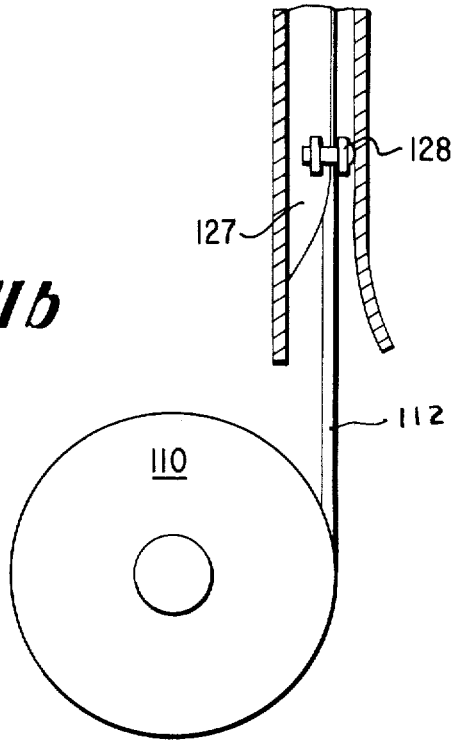

FIGS. 10*a* and 10*b* are a top plan view and a fragmented side view of a textile machine embodying a doffer and the anti-noise arrangements; and FIGS. 11*a* and 11*b* are detail views of the suspension and guide devices for the foil webs.

Figure 1A:
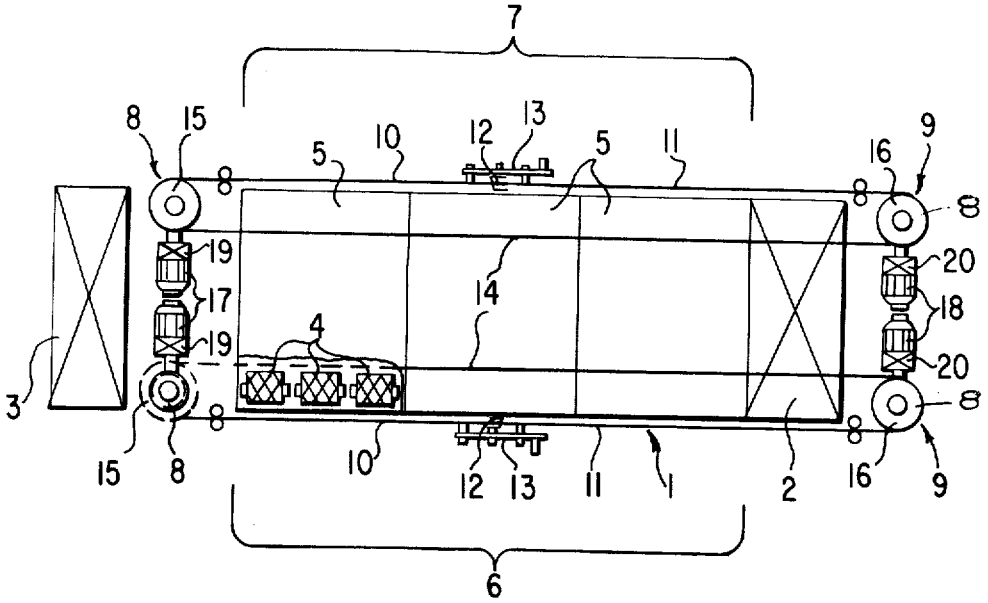

In FIG. 1*a* there is represented in plan and partly in horizontal section a two-sided textile machine, in the example a false-twist crimping machine. In the interest of completeness it should be mentioned that the invention is applicable obviously also to one-sided textile machines, such as, for example, the windings in chemical fiber spinning installations (cf., for example, German Utility Model Nos. 1,988,297 and 1,979,727). The textile machines consist of an end portion 2 which contains the drive gear and, by its nature, has to be firmly connected with the textile machine. The other end portion 3 of the textile machine contains preferably the electrical and electronic switching, control and regulating devices. This portion 3 can be set up spatially separate from the textile machine.

Figure 1B:
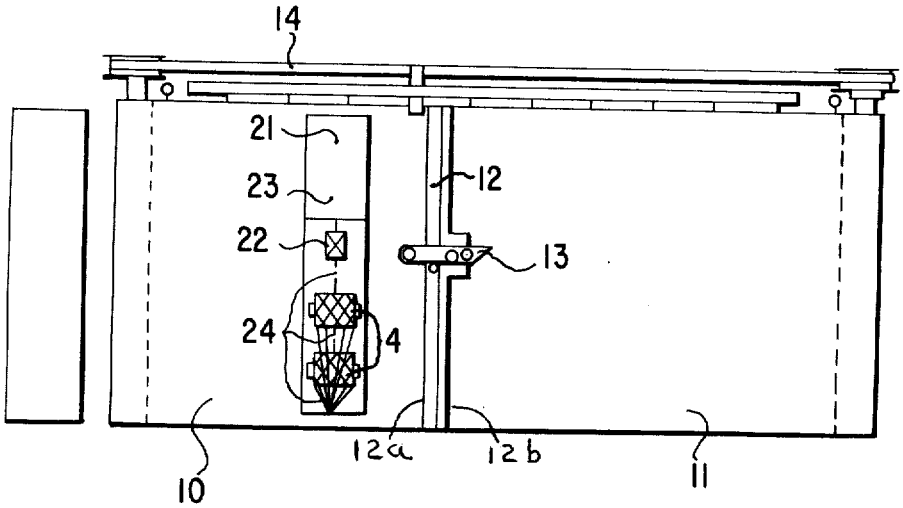

In the sectioned part of FIG. 1*a* there are visible the thread take-up reels 4, which—as is to be perceived in FIG. 1*b*—are arranged in stages one above another. Through the viewing window 21 according to FIG. 1*b* there can be seen, therefore, two working positions allocated to one another, and with which are associated a double false twist spindle 22, a heating device 23 and two threads 24 to be processed. Otherwise, the thread treatment places of the machine are comprehended by the zones 5. What is to be shielded is the entire front of the treatment places, which, therefore, for the embodiment shown is to be designated in the sense of this invention as the shielding zone 6. It should be mentioned that the illustrated two-sided textile machine has on the other side a second shielding zone 7. The following description, however, relates principally to the machine side represented in side elevation to FIG. 1*b*.

The sound-damping shielding of the zone 6 is accomplished by the foil webs 10 and 11. The foil storers 8 and 9 are take-up winding devices. Each take-up device consists of a fixed axis, rotatable roller with a vertical axis. The roller is driven by motor 17 via gear and switching coupling 19 in the winding direction. The foil storer 8 is positioned between the one end of the machine and the electric portion 3 in such a way that the machine front has no severely overhanging parts and, therefore, the tending operation is not hampered either in the case of manual operation or in the case of automatic tending. The foil storer 9, which is arranged on the opposite side of the machine, is constructed exactly like the foil storer 8. The drive takes place through motor 18 via the gear and switching coupling 20. The two foil webs 10 and 11 extend—as is to be seen from FIG. 1*b*—over the entire height of the machine. Obviously an anti-noise arrangement also can function effectively when it covers only a part of this height. The winders 4 have proved to be especially strongly noise-emitting, so that a considerable noise reduction can also be achieved by covering merely the winding system by an anti-noise device according to this invention.

In the closed state the foil webs 10 and 11 abut upon one another at the seam 12. The seam is formed with a U-shaped bar 12*a* joined to the foil web 10 and a groove bar 12*b* joined to the contiguous end of the foil web 11. The two foil webs 10 and 11 are joined with one another by slide bolt 13 so that the two foil webs are movable with synchronous speed with seam 12 closed, as one of the motors 17 or 18 is driven in foil-pull direction and the other switching coupling 19 or 20 in each case is brought out of engagement.

In order to establish an opening at the seam 12 of the two foil webs 10 and 11, through which one or several thread treatment positions can be tended, the slide bolt 13 is opened by hand. Let it be remarked that for the effective reduction of the noise nuisance the foil webs 10 and 11 should always be moved with seam 12 closed. After the opening of the slide bar (bolt) 13 the pulling foil web is driven onward by the prescribed opening width.

To close the seam 12, there is provided the cable 14. This cable is connected with the foil web 10, as is to be seen from FIG. 1*b*. It is suited, therefore, for closing the foil web 10—in the viewing direction of FIG. 1*b*—to the right and thereby closing the seam 12. The slide bolt 13 falls, by consequence of its constructive design, automatically over its catch. Now the seam can be shifted as a shielding unit by drive of the foils by means of motor 18 and winding take-up device 9, to the right and, by drive of the foils by means of motor 17 and take-up device 8, to the left.

In the embodiment illustrated, there is a driven cable pulley 15 (the motor of which is not shown) and a cable idler pulley 16. In the example of execution the pulleys 15 and 16 are journalled coaxially with the take-up. It is self-evident that this coaxial execution is in no way essential to the invention.

Figure 2:
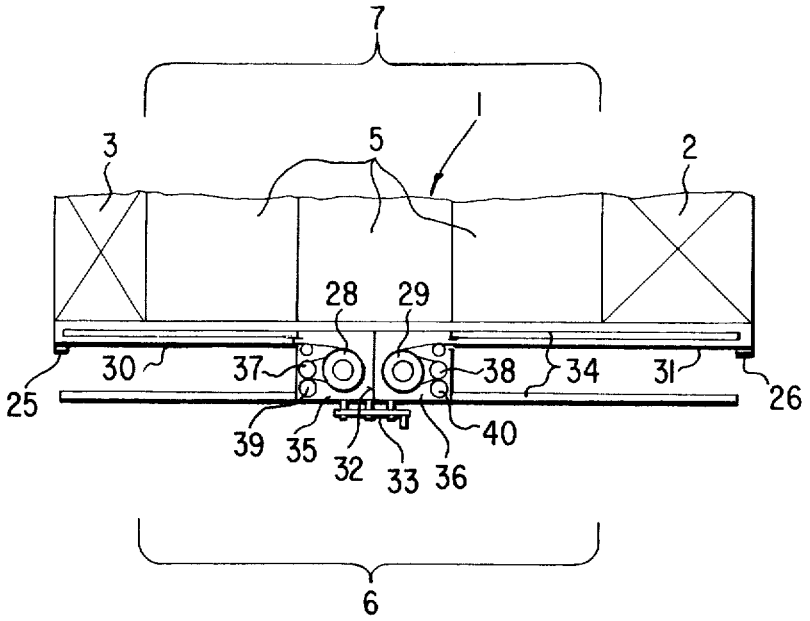
FIG. 2 shows in top plan a fragment of a two-sided textile machine, in which the foil webs extend over the entire longitudinal wall of the machine, and in which there are provided movable wind-up carriages, which are drivable along the machine front.

In FIG. 2 there is shown in top plan view a textile machine 1 with the shielding zone 6. The foil webs 30 and 31 in FIG. 2 are securely clamped with their ends 25 and 26 in fixed position at the opposite ends of the zone of the machine. The foil storers are the winding devices. These winding or take-up devices are rotatably journalled on the reciprocable winding carriages 35 and 36 and are driven by the winding drive motors 37 and 38 in winding take-up direction. The winding carriages 35 and 36 are drivable on the rails 34 over the entire length of the shielding zone 6 and both winding carriages 35 and 36 have running drive gears 39 and 40. The winding carriages 35 and 36 are connected with one another by the mechanical bolting 33. In order to move the seam 32 between the winding carriages 35 and 36, the winding drive 37 is operated for the movement to the left or the winding drive 38 for the movement to the right. To open the seam 32 the slide bolt 33 is opened and then either the winding drive 37 or the winding drive 38 or both are simultaneously operated. To close the seam 32 travel drive 39 or 40 is activated, or both may be activated simultaneously, to bring the carriages together. In a simpler and cheaper form of the FIG. 2 embodiment, one of the travel drive gears 39 or 40 is omitted. The closing of the seam place 32 then has to be accomplished in each case by means of the other travel gear drive. As already stated in reference to the embodiment according to FIG. 1*a*, 1*b*, the take-up winding can take place, again, preferably over gears and switching couplings not represented, so that differences resulting in the winding process due to the respective winding speeds of the take-up rollers 28 and 29 can be compensated.

Figure 3:
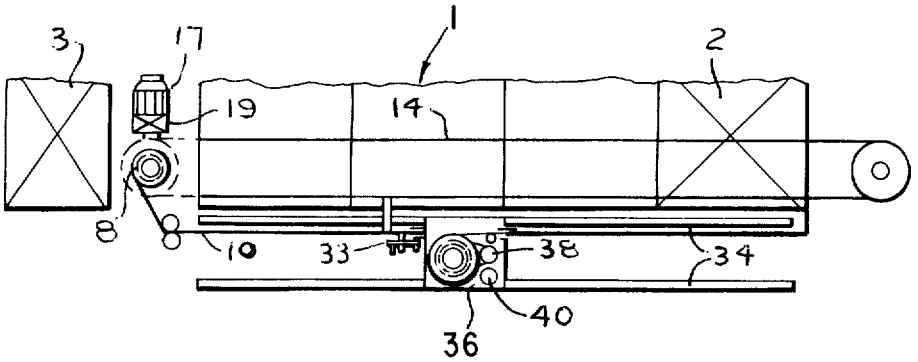
FIG. 3 shows in top plan a fragment of a two-sided textile machine, in which the foil webs extend over the entire longitudinal wall of the machine and in which, on the one hand, there is provided a fixed take-up according to FIG. 1 and, on the other hand, a take-up winding arrangement on a movable winding carriage according to FIG. 2.

In FIG. 3 there is shown an embodiment of a textile machine 1 with anti-noise structures. The embodiment in its left portion (as seen in FIG. 3) has a foil web 10 whose take-up storage to the left takes place exactly as in FIG. 1*a* and to the right exactly as in FIG. 2. The advantage of this example of execution lies in that the tending passage in front of the machine is taken up exclusively by a single winding carriage 36. The textile machine, therefore, is tended both by hand and also by means of a doffer (not shown) always from the left, which in some cases is not only possible but also expedient.

Figure 4:
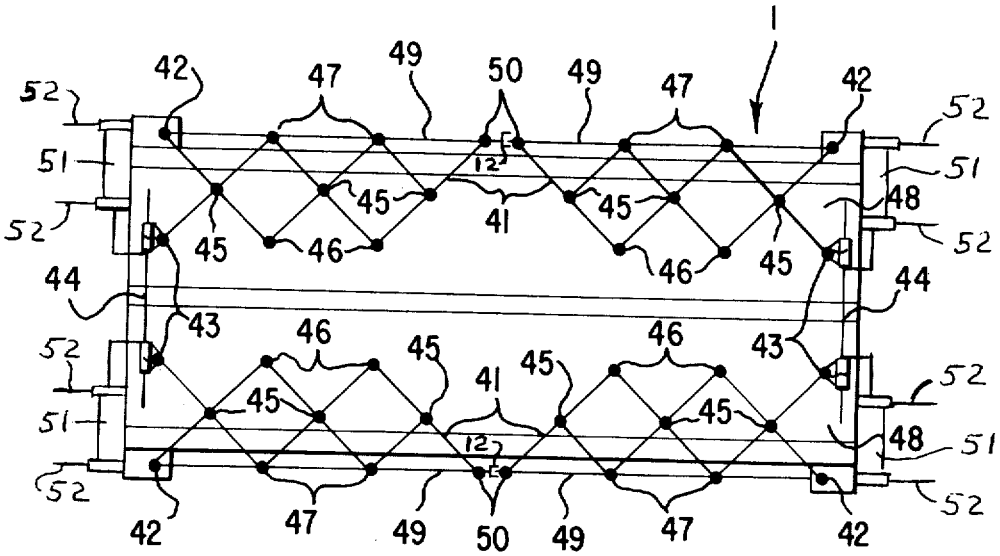
FIG. 4 shows a top plan view of a two-sided textile machine with "Nuremberg shears" as folding devices for the anti-noise curtains or foils.
Figure 5:
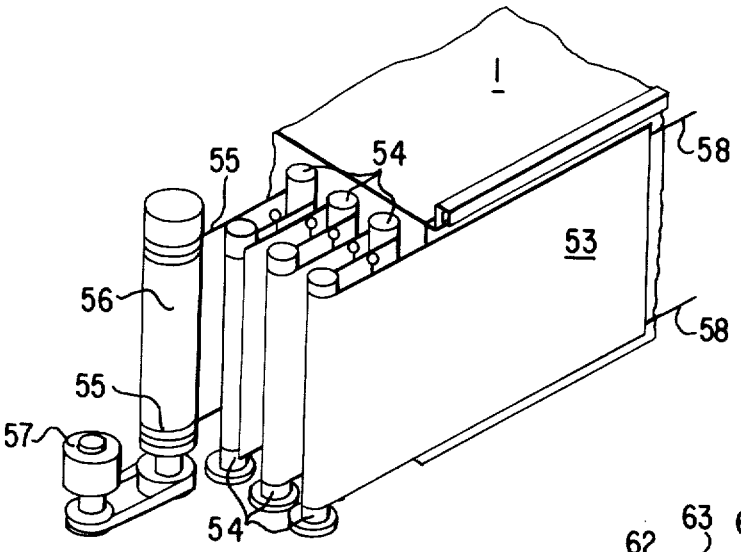
FIG. 5 is a perspective view, partly in fragment, of an embodiment of a foil storer.

FIGS. 4 and 5 illustrate other examples of foil storers. FIG. 4 is the top plan view of a textile machine 1. On the textile machine or a structure thereabove there is mounted a Nuremberg shears 41. End joints 42 of the Nuremberg shears are solidly joined with the textile machine or a structure thereabove, e.g., at the four corners of the machine. Further end joints 43 are slidable in or on the guides 44. * In the other joints 45, 46, 47 the lever arms are pivotally joined with one another. The joints 45 and 46 lie on a suitable guide—for example, a plastic plate—so that a silent shifting of these joints is possible. Each Nuremberg shears extends with its side joints 47 projecting beyond the longitudinal wall or walls of the textile machine. They have hooks—not visible in FIG. 4—or other suspension devices by which the foil 49 is suspended on joints 47.

*For operating the Nuremberg shears, each end joint 43 is fixed at the piston rod of a cylinder piston system 51, which is connected rigidly with the machine. Said system 51 is joined by the pressure means connections 52 to a non-shown fluid pressure source.
Thereby, each foil 49 can be stretched out over the entire shielding zone or else they can be folded up at the ends of the machine.

FIG. 5 is a perspective view of a textile machine 1. Here the foil web 53 is conducted in an undulated path at one end of the machine over a series of staggered, freely rotatable deflection rolls 54, so that between the first and last deflection rolls 54 there is a large foil storage capacity. One end of the foil 53 is connected to the cables 55, which in turn are wound onto the winding roller 56, the latter being rotatably driven about its fixed axis of rotation in the cable-winding direction by the drive gear-belt-pulley unit 57 to attain retraction (opening) of the foil web 53. The movement of the foil web in the closing direction is accomplished by cable pulls 58, which are attached to the other, free end of the foil web, and likewise can be wound up by suitable winding rollers and drives (not illustrated in FIG. 5).

Figure 6:
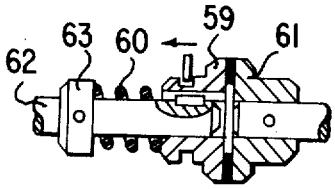
FIG. 6 is a partly sectioned view of a slip coupling for use for a foil storer.

FIG. 6 shows as a detail section view an embodiment of a take-up winding drive with a suitable switching and slip coupling of simple construction to drive the take-up rollers for the foil webs and to compensate for the speed differences arising in the process in the case of large or small winding diameters. The engageable and disengageable clutch member 59 is pressed into the clutch-engaged, operating state by the spring 60 against the driven clutch member 61. The spring 60 bears against a collar 63 axially slidably mounted on the drive shaft 62 and fixed at any axially adjusted position by a set screw or the like. Thereby the torque transferrable from the particular motors in each case to the foil take-up rollers can be limited in such a way that the speed of the foils to be wound up can be adapted independently of the desired turning rate of its drive motors to the speed of the other foil or of a cable pull unit by adjusting the force exerted by spring 60 in each clutch unit to create slippage between the clutch faces of clutch members 59 and 61.

Figure 7:
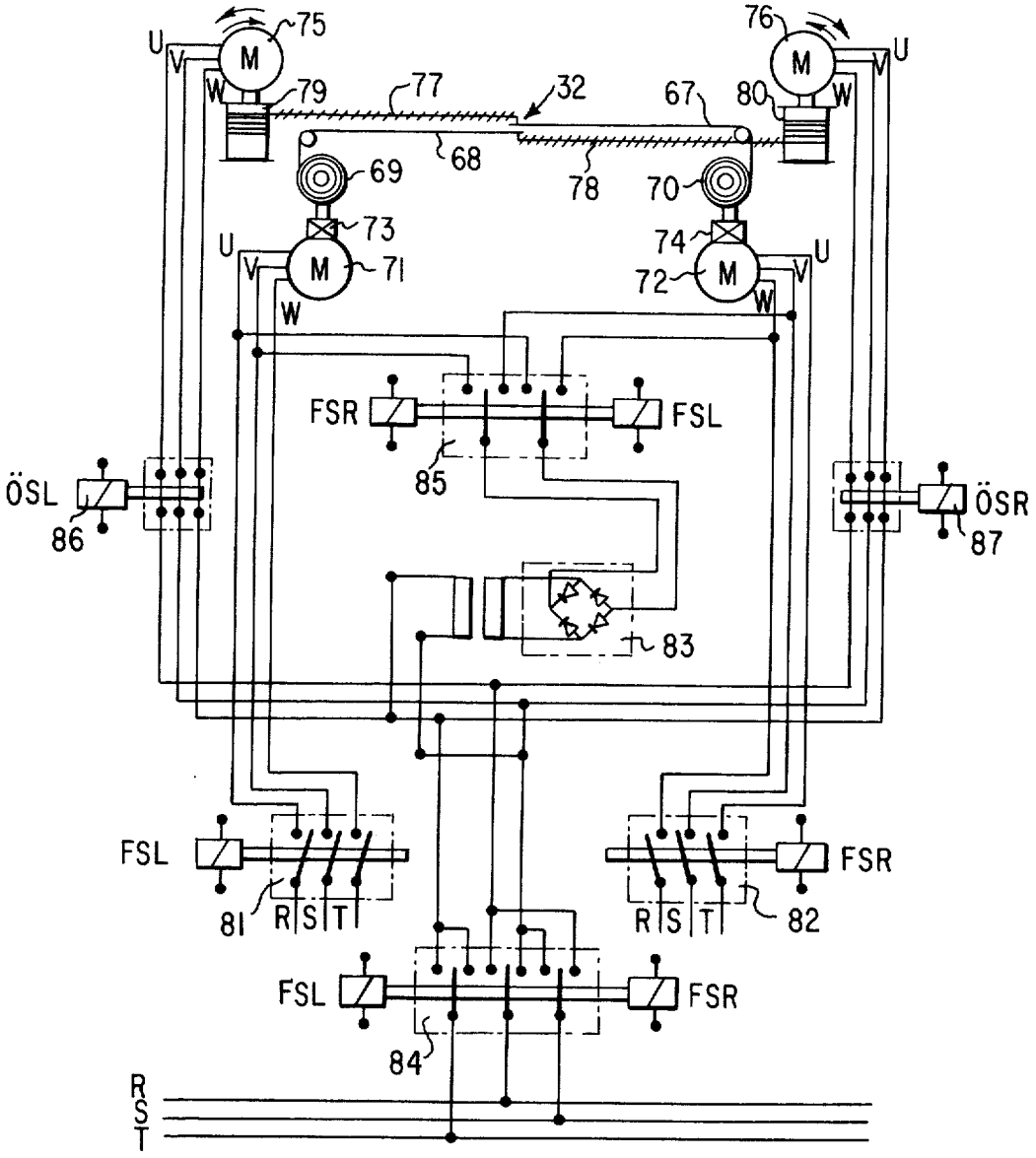
FIG. 7 is an electro-mechanical diagram of the switching program for the motor drive of the anti-noise arrangement of the invention.

FIG. 7 is a schematic representation of a drive system useful in the various anti-noise arrangements of the invention and the associated electrical circuitry thereof. The sound-damping foil webs 67 and 68 are wound on the take-up rollers 69 and 70 by the asynchronous motors 71 and 72 via the slip-adjustable couplings 73 and 74. The foil web 68 is connected with the cable 78 and the foil web 67 within the cable 77. The cables 77, and 78 are wound on the take-up rollers 79, 80 by asynchronous motors 75, 76.

The anti-noise arrangement executes the following functions:

a. Both foils are moved, with seam joint 32 closed, at a synchronous speed to the left or to the right.
b. For the opening of the seam joint 32 the foil 68 is moved to the left and/or the foil 67 is moved to the right.
c. The foils 67 and 68, with seam joint open, are moved at a synchronous speed to the left or to the right.
d. For the closing of the seam joint, the foil 68 is moved to the right and/or the foil 67 to the left.

Which switchings are to be made for the execution of these functions (*a*) to (*d*) is evident from the following tables. The data given in the vertical columns have the following signification:

First column (Motor): Reference numbers of the motors in FIG. 7;
Second column (Function): Function of the motors for the execution of the functions of the anti-noise arrangement represented under (*a*) to (*d*);
Third column (Switch): Reference numbers of the switches from FIG. 7;
Fourth column (Switching position): Switching position of the switches of column 3 for the execution of the motor functions indicated in column 2;
Fifth column (Relay): Reference symbols of the switching relay to be energized for the bringing about of the switching position according to column 4.

(a) To the left

| Motor | Function | Switch | Switching position | Relay |
|---|---|---|---|---|
| 71 | Pulls | 81 | Closed | FSL |
| | | 85 | Open | — |
| 72 | Stands | 82 | Open | — |
| | Brakes | 85 | Closed | FSL |
| 75 | Pulls | 84 | Closed | FSL |
| | | 86 | Closed | — |
| 76 | Synchronizes | 84 | Closed | FSL |
| | | 87 | Closed | — |

(a) to the right

| Motor | Function | Switch | Switching position | Relay |
|---|---|---|---|---|
| 71 | Stands | 81 | Open | — |
| | Brakes | 85 | Closed | FSR |
| 72 | Pulls | 82 | Closed | FSR |
| | | 85 | Open | — |
| 75 | Synchronizes | 84 | Closed | FSR |
| | | 86 | Closed | — |
| 76 | Pulls | 84 | Closed | FSR |
| | | 87 | Closed | — |

(b) Foil 68 to the left (opening)

| Motor | Function | Switch | Switching position | Relay |
|---|---|---|---|---|
| 71 | Pulls | 81 | Closed | FSL |
| | | 85 | Open | — |
| 72 | Stands | 82 | Open | — |
| | Brakes | 85 | Closed | FSL |
| 75 | Stands | 84 | Closed | FSL |
| | | 86 | Open | OSL |
| 76 | Synchronizes | 84 | Closed | FSL |
| | | 87 | Closed | — |

(b) Foil 67 to the right (opening)

| Motor | Function | Switch | Switching position | Relay |
|---|---|---|---|---|
| 71 | Stands | 81 | Open | — |
| | Brakes | 85 | Closed | FSR |
| 72 | Pulls | 82 | Closed | FSR |
| | | 85 | Open | — |
| 75 | Synchronizes | 84 | Closed | FSR |

-continued (a) To the left

| Motor | Function | Switch | Switching position | Relay |
|---|---|---|---|---|
| | | 86 | Closed | — |
| 76 | Stands | 84 | Closed | FSR |
| | | 87 | Open | OSR |

(c) Like (a), above (d) Foil 67 to the left (closing)

| Motor | Function | Switch | Switching position | Relay |
|---|---|---|---|---|
| 71 | Stands | 81 | Open | FSL |
| | | 85 | Open | — |
| 72 | Runs | 82 | Open | — |
| | Brakes | 85 | Closed | FSL |
| 75 | Pulls | 84 | Closed | FSL |
| | | 86 | Closed | — |
| 76 | Stands | 84 | Closed | FSL |
| | | 87 | Open | OSR |

(d) Foil 68 to the right (closing)

| | | | | |
|---|---|---|---|---|
| 71 | Runs and brakes | 81 | Open | — |
| | | 85 | Closed | FSR |
| 72 | Stands | 82 | Closed | FSR |
| | | 85 | Open | — |
| 75 | Stands | 84 | Closed | FSR |
| | | 86 | Open | OSL |
| 76 | Pulls | 84 | Closed | FSR |
| | | 87 | Closed | — |

In the diagrammatic switching circuits according to FIG. 7 the foil-travel relays FSL and FSR are represented, in which arrangement the relays FSL initiate essentially the movement of the anti-noise arrangement to the left and the relays FSR initiate the movement of the anti-noise arrangement to the right. Further, other relays are the opening relays ÖSL and ÖSR, which function for the left or right movement in each case of only one foil web. It is contemplated that other electrical equivalents may be used instead of relays, e.g., magnetic switches.

The switching control for the motors 75 and 76 is the turning direction reversing switch 84. This switch is circuited in such a way that the motors 75 and 76, on operation of the relays FSL or FSR always rotate at preselected rotational direction. For the opening and closing of the seam joint 32, i.e., for the movement to the left and right of only one foil web, the switches 86 or 87 are opened by their respective opening relays ÖSL and ÖSR.

The energy supplied to the motors 71 and 72 takes place via the switches 81 and 82, respectively, and conductors diagrammatically represented by R, S, T and U, V, W. The motors 71, 72 can be direct-current-braked, which serves essentially to keep the individual foil webs always under the required tension. The direct-current is supplied by the rectifier 83. This consists of an adjustable transformer and of a rectifier circuit. For the switching on of the direct-current braking there is provided the reversing switch 85, which through the foil-travel relays FSL and FSR alternately sets in operation the motor braking for the motors 71 and 72.

Figure 8:
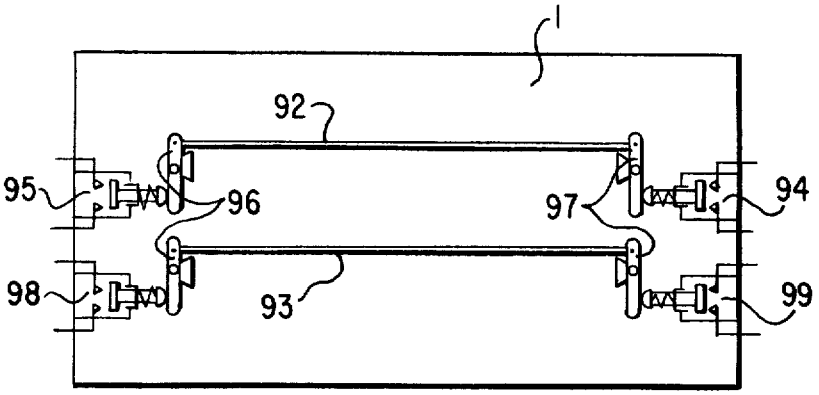
FIG. 8 is a detail view of switches for operating the motor drives.

FIG. 8 shows semi-diagrammatically the operating mechanisms and switches of relays FSL, FSR, ÖSL, and ÖSR. For the operation of the mechanical switches 94, 95, 98, 99 there are provided on the textile machine 1, whose longitudinal front is depicted in block diagram in FIG. 8, switching rods 92 and 93 which extend over the entire length of the shielding zone. Switching rod 92 acts via the levers 96 and 97 on the switches 94, 95 and serves thereby for the activation of the relays FSL and FSR.

Figure 9:
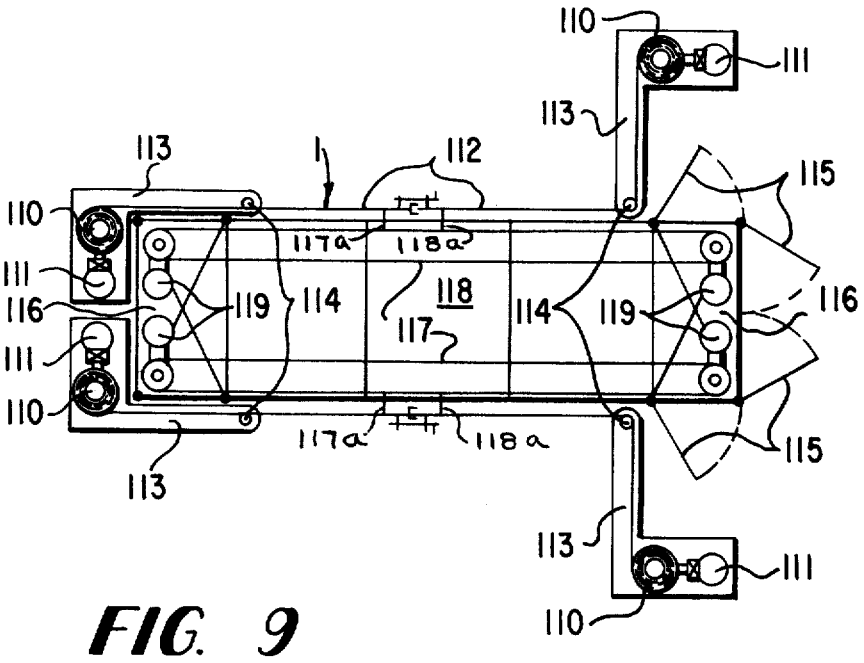
FIG. 9 is a top plan view of a textile machine with winding arrangements capable of pivoting outwardly.

By pull of the switching rod 92 to the left the switch 94 is operated and thereby the anti-noise arrangement is moved to the left. By pull to the right, switch 95 is operated and thereby the anti-noise arrangement is moved to the right. The switching rod 93 similarly operates the switches 98, 99 of the opening relays ÖSL and ÖSR. Switching rod 93 serves thereby for the opening and closing of the seam joint of the anti-noise arrangement. FIG. 9 shows a plan view of a textile machine 1 with the end portions 116 containing the machine's main drive components and electrical/electronic components. Both end portions must be accessible for tending, for example, through the doors 115. In order to clear the doors, the take-up devices 110 with the winding motors and couplings 111 are borne on the carriers 113. The carriers 113 are swingable about the vertical shafts 114. The axial shafts 114 carry simultaneously vertically standing guide rolls, which extend over the entire height of the foil webs and on swinging out of the carriers 113 take over the deflection of the foil webs 112 which is shown in the upper right part of FIG. 9.

In this embodiment the foil-pulling cables 117, 118—of which 118 lies in viewing direction under 117 and therefore is hidden in FIG. 9—are borne by the drives 119 of the machine. Accordingly, the cables 117 and 118, which have the function of pulling the foil webs 112 from the take-up rollers of devices 110 via cable-foil connectors **117*a* and 118*a* do not hamper the tending of the machine and, in particular, of the machine parts 116**.

FIG. **10*a* shows the plan view and FIG. 10*b* the elevation of a textile machine, in which the foil webs 112 are moved by the bobbin doffer 120. The doffer 120 is travellable along the machine front, i.e., in the present embodiment also along the shielding zone, on rails 121 by means of a drive 123 of its own in both directions. The doffer can be positioned in front of any thread treatment place in order to remove full bobbins and to install empty tubes in the winding arrangements of the textile machine. The ends 112*a* of the foil webs are connected with the doffer by latch closures 122. Suitable construction forms of such doffers are found, for example, in published German Pat. application No. OS 21 23 689 and published German Pat. application No. OS 21 28 974. For the explanation of FIG. 10*b* let it be mentioned that the foil web shielding zone extends in vertical direction only over the region of the windings. The whole textile machine may include further in its respective thread treatment positions a false-twist crimping unit comprising the upper heating device 124, the false twist spindles 125 and also the delivery mechanisms 126**.

The foils, especially with the preferred specific weights of 4 to 6 kg/dm$^3$, are suspended advantageously in running rails. These running rails must be interrupted in the region of the foil storer. FIG. 11 shows the construction of such a running rail in the region of the foil storer. The running rail 127 is formed in such a way that the foil suspension units 128 thread themselves without difficulties automatically into the running rail when they come from the winding 110. On the other hand, the suspension 128 on the winding 110 must not take up too much space.

It should further be mentioned that the operation of the motor drives can also be accomplished through a thread-breakage monitor, as is allocated to each treatment place in signalize a thread break and/or to stop the treatment place functioning. Such thread-breakage monitors with corresponding switching arrangements are known, for example, from Swiss Pat. No. 431,800. Through the setting in operation of the anti-noise system, the seam existing between the foil webs can be shifted to the processing place that has been brought to a standstill, so that in the reapplying of the thread there do not arise any additional standstill times for the laying open of the place to be serviced. Obviously it is necessary that each thread monitor be connected to a suitable switching system, through which the drives for the foil webs can be brought to a standstill when the seam between the foil webs has reached the processing place to be serviced. To accomplish this, for example, a limit switch can be shifted by the thread monitor into the proximity of the foil webs in such a way that a switching cam mounted at the seam joint of a foil operates the limit switch in a way that the drive motors are stopped.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A noise-dampening structure in combination with a textile machine having a plurality of thread treatment stations positioned at longitudinally spaced intervals along at least one elongated longitudinal face of the textile machine, said noise-dampening structure embodying sound-deadening web means for covering wholly or partially at least several of said stations on said longitudinal face of the textile machine and providing at least one noise-shielding zone opposite at least several of said stations, said web means comprising two, upstanding, horizontally-elongated, sound-dampening foils movable in the same or opposite horizontal directions seam-forming means providing a vertical seam between the respective foils, each foil having a length which is at least substantially the length of said noise-shielding zone whereby either foil may be extended across substantially the full length of said noise-shielding zone, and storer means for storing and releasing each respective foil to permit longitudinal, horizontal movement of the respective foils in said zone along the longitudinal face of the machine together in the same horizontal directions with said seam closed across substantially the full length of said noise-shielding zone and in opposite, horizontal directions to allow said foils to be separated at said seam-forming means to provide access to one or more of said stations.

2. A combination as claimed in claim 1, and foil-movement means for moving the two foils in either horizontal direction along the textile machine face either together at synchronous speed or at a speed and/or direction independently of the other foil.

3. A combination as claimed in claim 1, an automatic bobbin changing unit which is movable along the longitudinal face of the machine, said unit being positioned at said vertical seam between and movable simultaneously with contiguous ends of the foils.

4. A combination as claimed in claim 1 wherein said movable foils are respectively connected to cable pull means extending horizontally along the noise-shielding zone, motor drive means for moving the cable along said zone, and means connecting the cable pull means to respective foils for drawing the respective foils independently or individually from their respective foil storer means.

5. A combination as claimed in claim 1 wherein said foils are made of transparent material.

6. A combination as claimed in claim 1 where at least one of the foils is opaque and contains a transparent viewing window in the area of the separable end of the opaque foil.

7. A combination as claimed in claim 1, said foils being made of foil material having a specific weight of more than 4 $kg/dm^3$, preferably in the range of 4 to 6 $kg/dm^3$.

8. A combination as claimed in claim 1 wherein said respective storer means are located at opposite ends of said noise-shielding zone and said vertical seam is provided by seam-forming means along the vertical, storer-remote ends of said foils.

9. A combination as claimed in claim 1 wherein at least one of said storer means is positioned at said vertical seam, and carriage means for moving the storer means at said seam horizontally along said longitudinal face of said textile machine.

* * * * *